US006932326B1

(12) United States Patent
Krabbendam

(10) Patent No.: US 6,932,326 B1
(45) Date of Patent: Aug. 23, 2005

(54) METHOD FOR LIFTING AND TRANSPORTING A HEAVY LOAD USING A FLY-JIB

(76) Inventor: Richard L. Krabbendam, PO Box 23016, Rotterdam, 3001 KA (NL)

( * ) Notice: Subject to any disclaimer, the term of this patent is extended or adjusted under 35 U.S.C. 154(b) by 0 days.

(21) Appl. No.: 10/461,162

(22) Filed: Jun. 13, 2003

(51) Int. Cl.[7] ..... B66D 1/36

(52) U.S. Cl. ..... 254/334; 114/263; 114/264; 114/258; 405/200; 405/219; 212/307; 212/309

(58) Field of Search ..... 254/334; 114/263, 114/264, 258; 405/200, 205, 218, 219; 212/307, 212/309

(56) References Cited

U.S. PATENT DOCUMENTS 4,281,615 A * 8/1981 Wilson et al. ..... 114/265
5,456,622 A * 10/1995 Breivik et al. ..... 441/3
5,823,715 A * 10/1998 Murdoch et al. ..... 405/219
6,607,331 B2 * 8/2003 Sanders et al. ..... 405/196
6,718,901 B1 * 4/2004 Abbott et al. ..... 114/264
2002/0079278 A1 * 6/2002 Sanders et al. ..... 212/307

* cited by examiner

*Primary Examiner*—Emmanuel M Marcelo
(74) *Attorney, Agent, or Firm*—Buskop Law Group, P.C.; Wendy Buskop

(57) ABSTRACT

The invention is a method for lifting and transporting a heavy load by using a heavy lift vessel with at least two heavy lift cranes adapted to operate simultaneously; mounting fly-jibs on the heavy lift crane to increase reach and height of the heavy lift crane; picking up a load from a first location using the fly-jib modules simultaneously; shifting the load from the first location to over a second location on the heavy lift vessel; placing the load on the second location; moving the heavy lift vessel to a second position; using a mooring system to maintain the heavy lift vessel at the second position; picking up the load from the second location using the fly-jib modules simultaneously; shifting the load from a second location to over a third location; and placing the load on the third location.

20 Claims, 10 Drawing Sheets

METHOD FOR LIFTING AND TRANSPORTING A HEAVY LOAD USING A FLY-JIB

FIELD OF THE INVENTION

The invention relates to a method for lifting and transporting a heavy load using a heavy lift vessel with at least one heavy lift crane and fly-jib module mounted on the heavy lift cranes to increase reach and height of the heavy lift cranes.

BACKGROUND OF THE INVENTION

As global commerce has expanded, it has become increasingly necessary to effectively transport goods from one location to a remote location that transverses over water. Containers of goods are transported inland by means of railroads, trucks, inland waterway vessels, etc. The permissible range of operation of land-bound carriers or vessels for inland navigation ends at the coast. At that point, cargo transported by inland waterway vessels must be transferred from a non-seaworthy inland vessel to a seaworthy ship. Cargo must also be loaded from land locations to the seaworthy ships.

Transportation problems compound and the risk of loss increases as the cargo becomes heavier, requiring heavy lift cranes.

A need exists for a heavy lift vessel that can carry cargo, such as heavy structures, over long distances at a high speed.

Current methods for transporting heavy structures over waterways and the open oceans incorporate the use of barges as an intermediate transport vehicle. Currently, heavy structures are transported using barges. These methods are inconvenient, time-consuming, and costly to move heavy structures from one location to another. Conventional installation vessels, such as crane barges or crane vessels, require in most cases a separate barge or heavy lift transport vessel to transport the offshore structures.

Since the use of multiple vessels and barges increases the risk of damage to the cargo and workers, a need exists for a heavy lift vessel that can self-load, transport, and install cargo in one vessel. The use of one vessel versus multiple vessels would lower insurance premiums and also provide a safer environment for both cargo and the workers on the ship.

SUMMARY OF THE INVENTION

The invention relates to a method for lifting and transporting a heavy load using a heavy lift vessel with at least two heavy lift cranes, wherein a fly-jib module is mounted on the heavy lift crane to increase reach and height of the heavy lift cranes. The method entails picking up a load from a first location using the fly-jib modules simultaneously, shifting the load from the first location to over a second location, wherein the second location is on the heavy lift vessel; and placing the load on the second location. The heavy lift vessel, then, moves from the first position to second position. A mooring system is used to maintain the heavy lift vessel at the second position. The method ends by picking up the load from the second location using the first and second fly-jib modules simultaneously; shifting the load from a second location to over a third location; and placing the load on the third location.

BRIEF DESCRIPTION OF THE DRAWINGS

The present invention will be explained in greater detail with reference to the appended Figures, in which.

The present invention is detailed below with reference to the listed Figures.

DETAILED DESCRIPTION OF THE PREFERRED EMBODIMENTS

Before explaining the present invention in detail, it is to be understood that the invention is not limited to the particular embodiments herein and it can be practiced or carried out in various ways.

The present invention is a method for lifting and transporting a heavy load. The invention was developed to convert these heavy lifting ships into heavy transportation and installation vessels for use in the offshore sector. The preferred vessels are mono-hull transportation vessels, equipped with at least two heavy lift mast cranes.

The present invention is a method for lifting a load using a heavy lift ship equipped with modular units.

The fly-jib module is fitted to the existing crane jibs in order to extend outreach and lifting height of the crane. An example of the useful need of the fly-jib module is installing a topside construction onto floating production storage and offloading facilities (FPSO).

The suction anchor module when installed on the heavy lift ship stabilizes the roll, the pitch, and the heave of the vessel. The suction anchor module enables the stabilized vessel to work heavy lift cranes in an offshore environment under a significant wave height.

The deep water deployment system (or extra hoisting winches module) when connected to an individual heavy lift crane increases the wire rope storage capacity. The deep water deployment system is typically positioned in the lower hold. A set of guide sheaves replaces the existing hoist winches of the individual heavy lift crane to achieve an increased hook travel of the main crane blocks. The increased hook travel allows the heavy lift vessel to be able to lower subsea structures to a water depth of up to 3000 meters.

The modular dynamic positioning system allows the heavy lift vessel to operate within a deep water environment without conventional mooring anchors.

The modular heave compensation system is typically installed in the main hoist wire rope tackle in order to absorb shock loads caused by the heavy lift vessel's motion when placing a load on the seabed.

Figure 1:
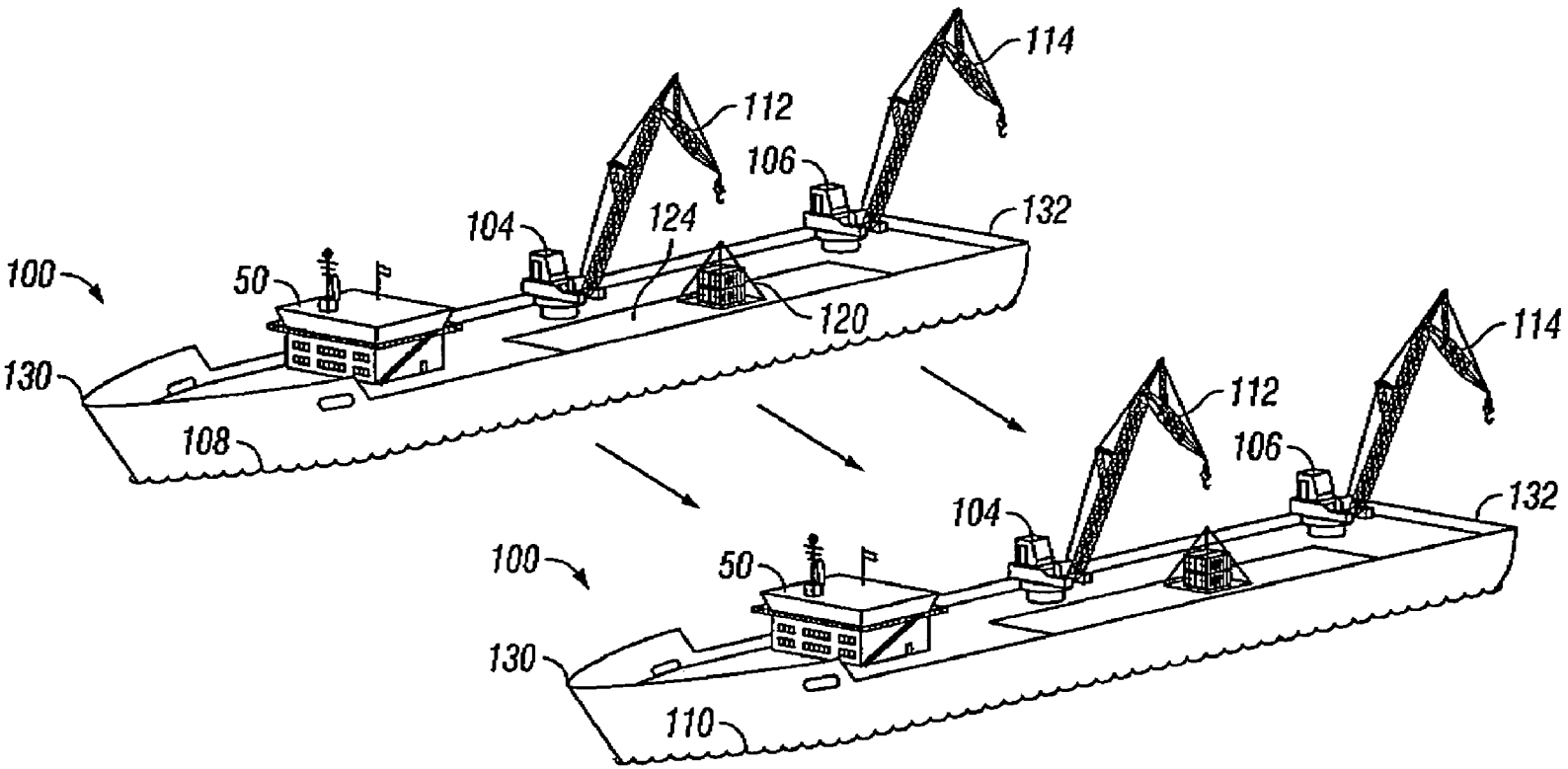
FIG. 1 depicts the heavy lift vessel lifting and transporting a load from a first position to a second position.

The present invention is a method for lifting and transporting a heavy load using a modified heavy lift vessel (100) as shown in FIG. 1. The typical heavy lift vessel has a bow (130), a stern (132) and a bridge (50). The method of inventions is applicable for any type of heavy lift vessel, such as mono-hull vessels, catamaran hull vessels, and tri-maran hull vessels. The heavy lift vessel can also be equipped with a heave compensator.

Figure 2A:
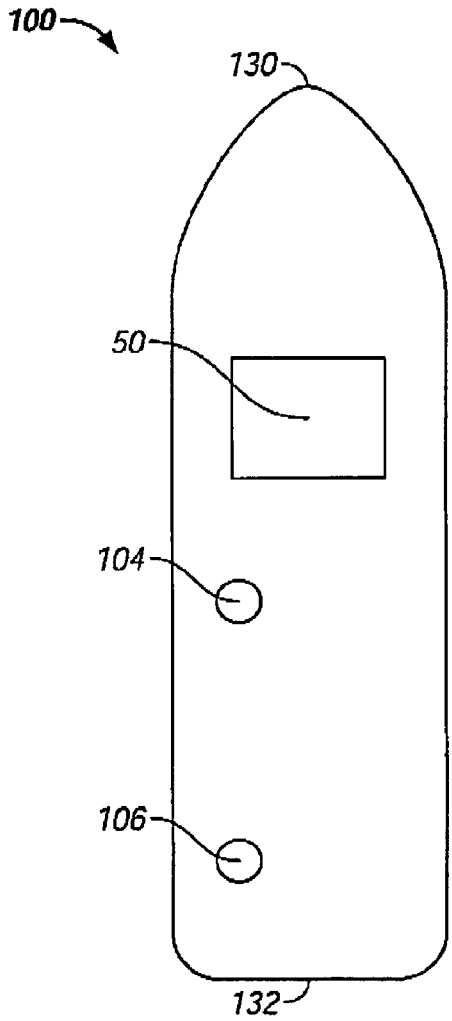
FIG. 2*a* depicts the positioning of the heavy lift cranes on the heavy lift vessel.
Figure 2B:
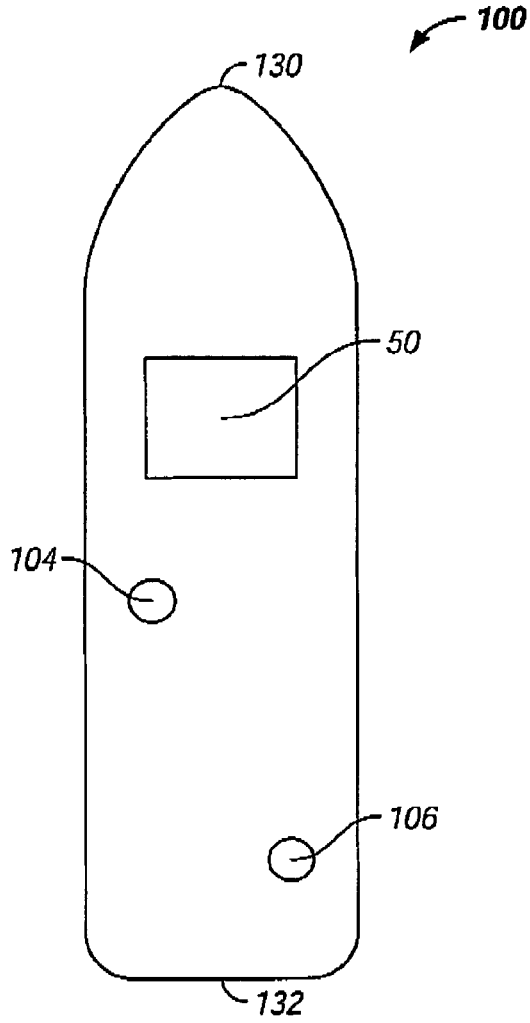
FIG. 2*b* depicts the positioning of the heavy lift cranes on the heavy lift vessel.
Figure 2C:
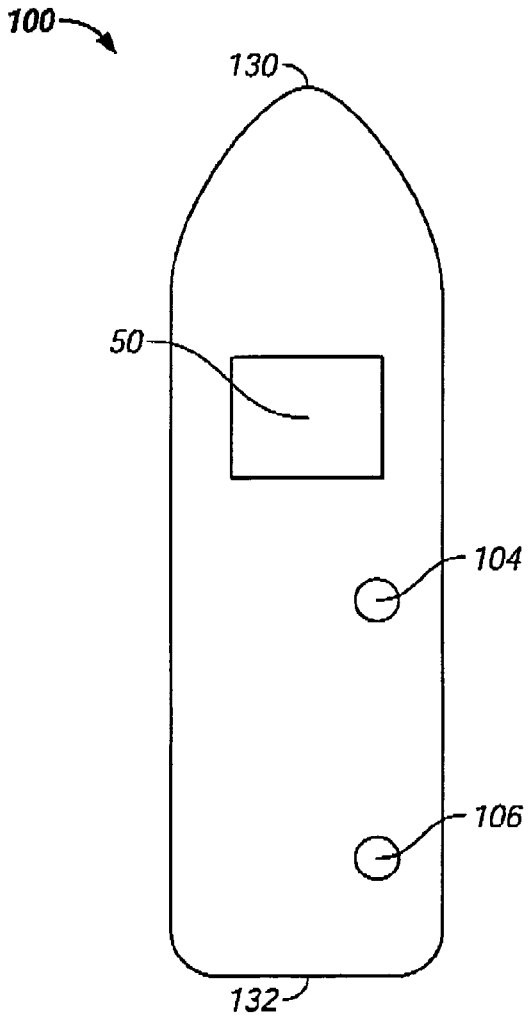
FIG. 2*c* depicts the positioning of the heavy lift cranes on the heavy lift vessel.
Figure 2D:
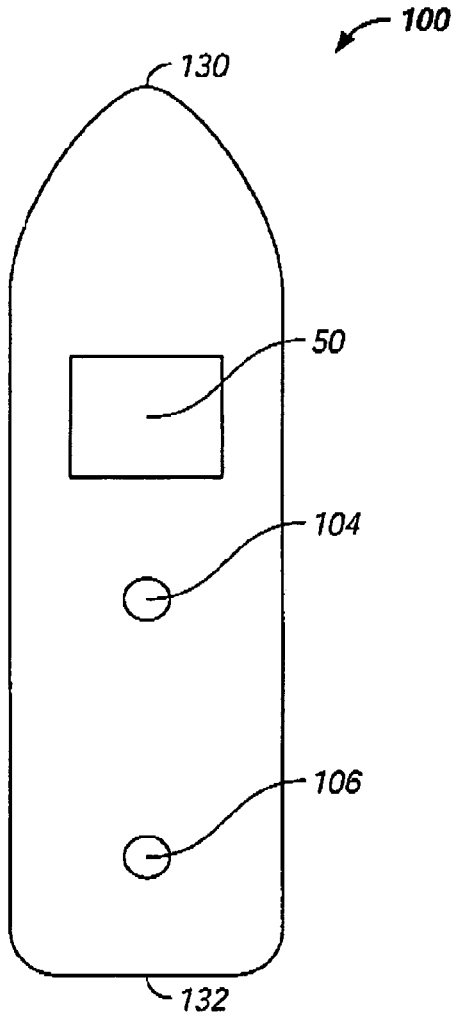
FIG. 2*d* illustrates a vessel having two cranes 104 and 106

The heavy lift vessel also has a first heavy lift crane (104) and a second heavy lift crane (106) connected to the heavy lift vessel adapted to operate simultaneously. The two heavy lift cranes can be placed in a variety of orientations on the heavy lift vessel. Examples of heavy lift crane orientations are shown in FIG. 2*a*, FIG. 2*b*, and FIG. 2*c*. FIG. 2*d* illustrates a vessel having two cranes 104 and 106 disposed thereon. A heavy lift vessel can also have a single heavy lift crane. The heavy lift cranes can also be mast cranes and other crane type lifting devices. Even though the preferred embodiment is two heavy lift cranes on a single heavy lift vessel, the invention contemplates that three or more cranes may be present.

Figure 3:
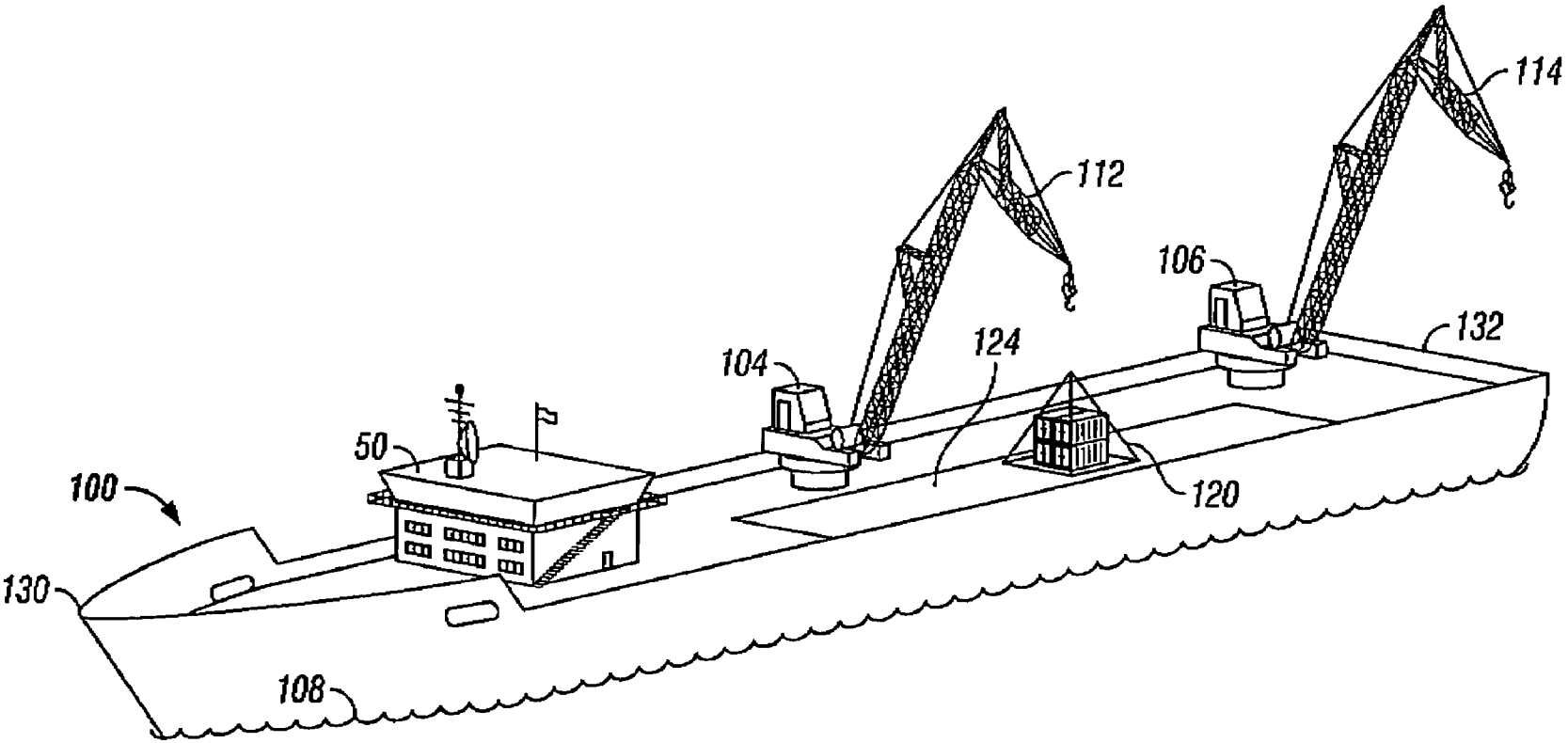
FIG. 3 depicts the heavy lift vessel with fly-jibs attached to the heavy lift cranes.

The heavy lift vessel (100) is initially modified by adding a first fly-jib module (112) to the first heavy lift crane and a second fly-jib module (114) to the second heavy lift crane. If a single lift crane is present, a fly-jib can be added to the single crane. The fly-jib modules are adapted to increase reach and height of a heavy lift crane. The fly-jibs attached to the heavy lift cranes are shown in FIG. 3.

Figure 4:
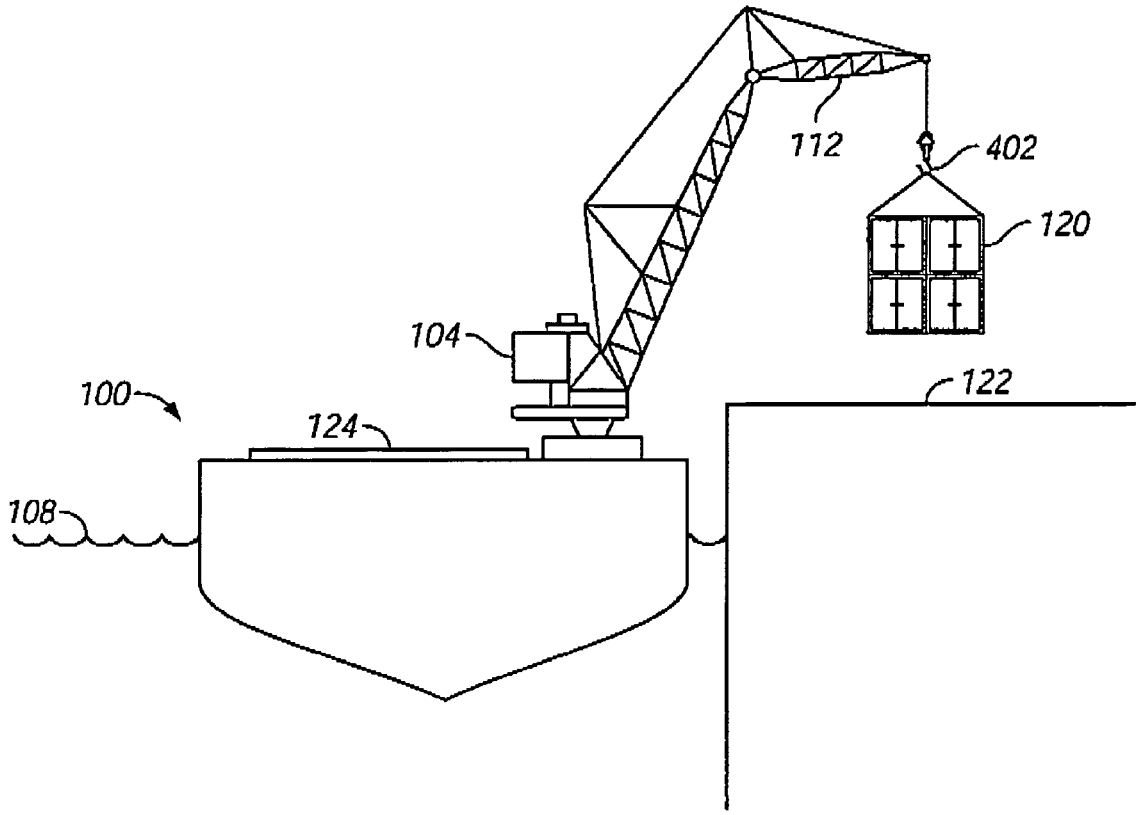
FIG. 4 depicts the heavy lift cranes picking up a load from a first location on land and placing it to a second location on a vessel.

As shown in FIG. 4, the method continues by picking up a load (120) from a first location (122) using the first and second fly-jib modules simultaneously, shifting the load from the first location (122) to over a second location (124) on the heavy lift vessel, and placing the load on the second location.

The heavy lift vessel with the load then moves from the first position where the load was added to a second position where the load is to be unloaded. A mooring system maintains the heavy lift vessel at the second position.

Figure 5A:
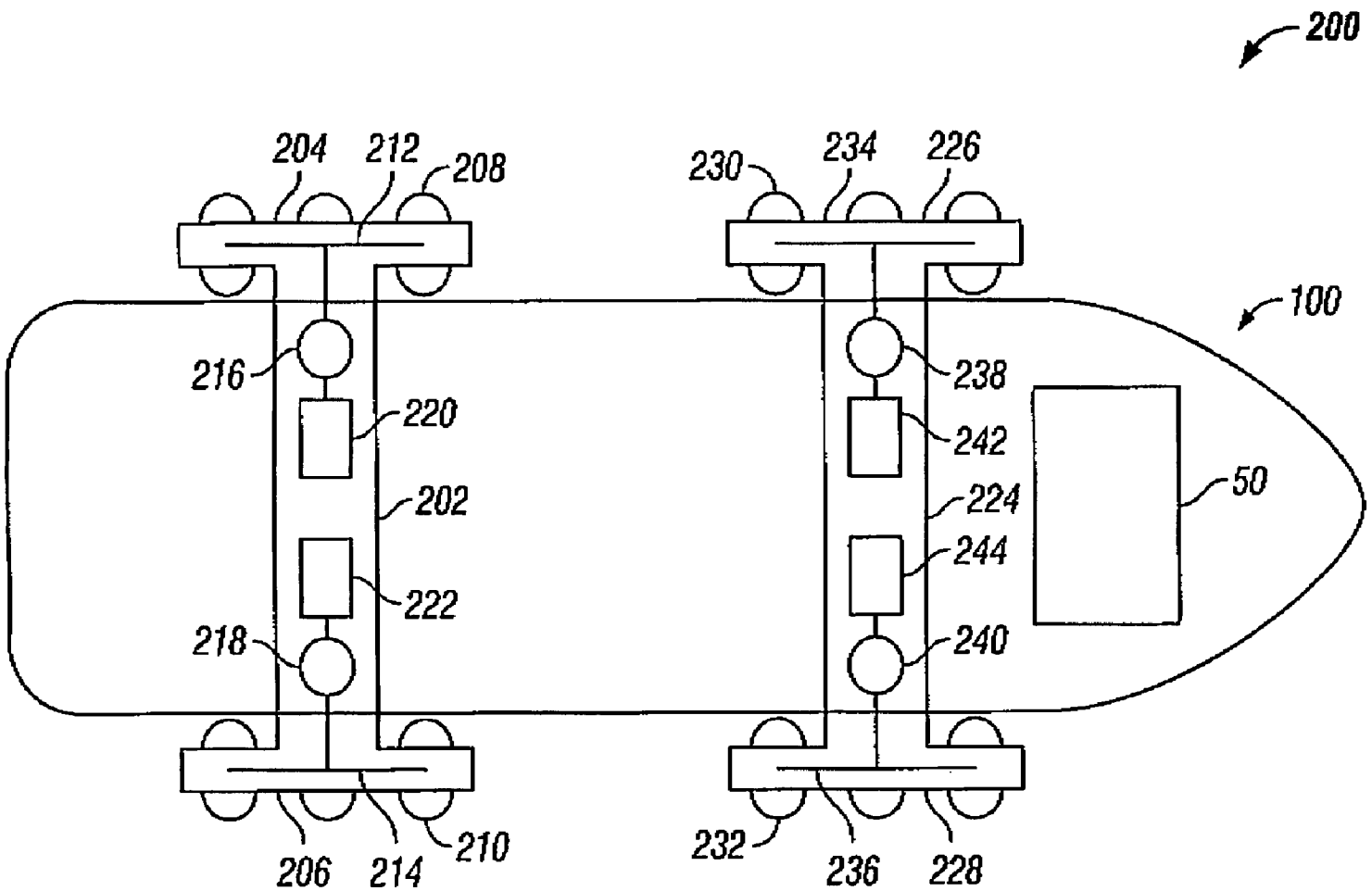
FIG. 5*a* depicts the mooring system as a suction anchoring system.

One mooring system that is used is a suction anchoring system (200) as seen in FIG. 5*a*. The suction anchoring system (200) is adapted to stabilize the heavy lift vessel from roll, pitch, and heave. The suction anchoring system (100) is a lifting device (202) with a first end (204) and a second end (206); a first anchor (208) and a second anchor (210); a first wire rope (212) connected to the first anchor and a second wire rope (214) connected to the second anchor; a first winch (216) disposed on the first end connected to the first wire rope and a second winch (218) disposed on the second end connected to the second wire rope; and a first heave compensator (220) connected to the first winch and a second heave compensator (222) connected to the second winch.

The suction anchoring system (200) can further include a second lifting device (224) with a second lifting device first end (226) and a second lifting device second end (228); a third anchor (230) and a fourth anchor (232); a third wire rope (234) connected to the third anchor and a fourth wire rope (236) connected to the fourth anchor; a third winch (238) disposed on the second lifting device first end connected to the third wire rope and a fourth winch (240) disposed on the second lifting device second end connected to the fourth wire rope; and a third heave compensator (242) connected to the third winch and a fourth heave compensator (244) connected to the fourth winch.

Each lifting device can include four winches and four heave compensators instead of the stated two winches and two heave compensators. The lifting device can also be a beam.

Figure 5B:
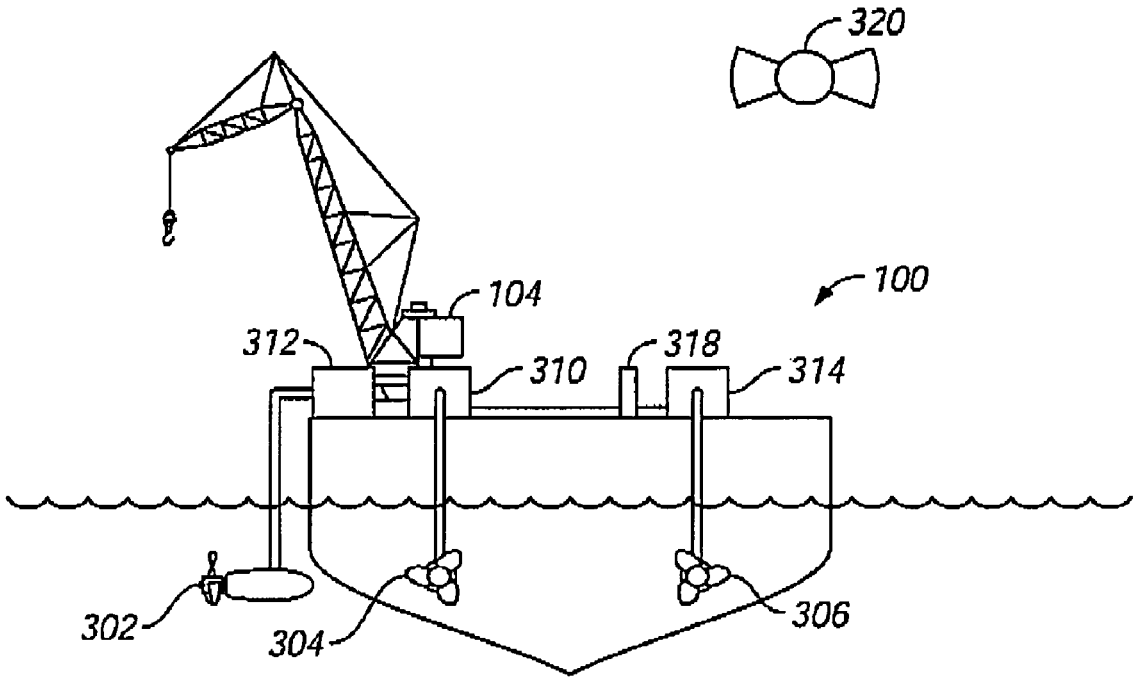
FIG. 5*b* depicts the mooring system as a modular dynamic positioning system.

Another mooring system is a modular dynamic positioning system (300) as seen in FIG. 5*b*. The modular dynamic positioning system (300) is a module added to the heavy lift vessel. The modular dynamic positioning system (300) has at least three propeller systems (302, 304, and 306) and at least three generators (310, 312, and 314). The generators are either diesel generators or diesel hydraulic power packs. Each propeller system is connected to a generator. The modular dynamic positioning system (300) also has a control device (318) and a satellite positioning network (320). The control device is connected to the satellite positioning network.

The modular dynamic positioning system (300) can also include four or more propeller systems, each connected to a generator.

Figure 5C:
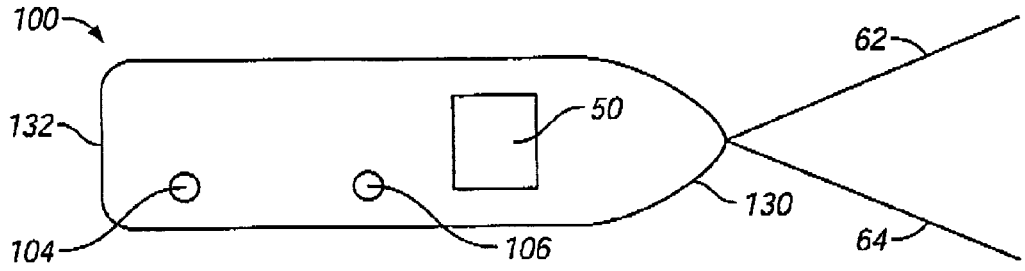
FIG. 5*c* depicts the mooring system as a conventional anchoring system.

Another mooring system is a conventional anchoring system as shown in FIG. 5*c*. The conventional anchoring system uses at least two anchors (62 and 64) connected to the bow of the heavy lift vessel and a seabed.

Figure 5D:
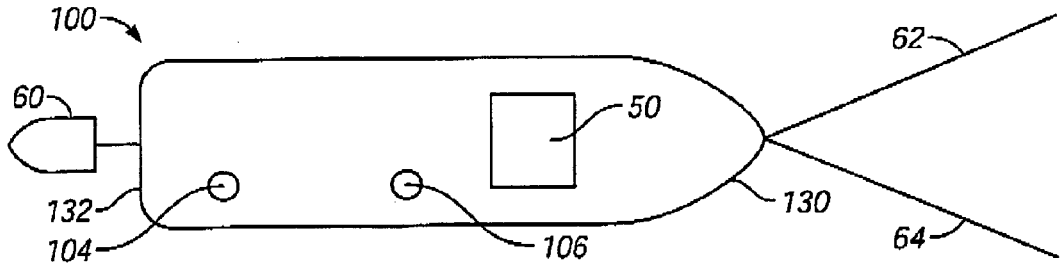
FIG. 5*d* depicts the mooring system as a conventional anchoring system with a tug to ensure the heading of the vessel.

The conventional anchoring system can also use a tugboat connected to the stern of the heavy lift vessel by a wire rope line in combination with at least two anchors (62 and 64) connected to the bow of the heavy lift vessel and a seabed. The tugboat maintains the heavy lift vessel in the direction of prevailing current and wind. The conventional anchoring system with the tugboat (60) is shown in FIG. 5*d*.

Figure 6:
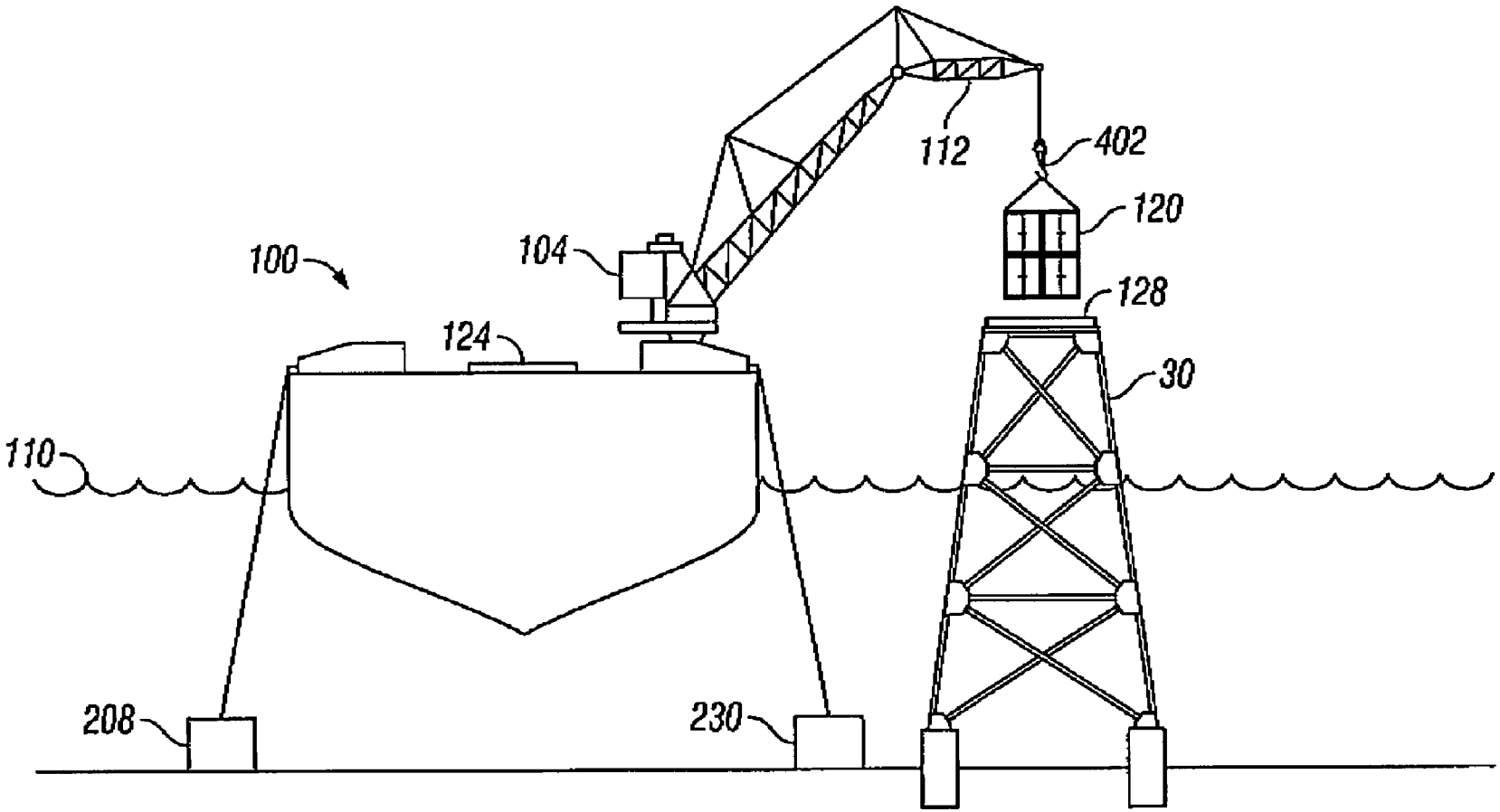
FIG. 6 depicts the heavy lift cranes lifting a load from a first location on a vessel and placing it at a second location on another vessel.

While the mooring system (126) maintains the heavy lift vessel at the second position, the method continues by picking up the load (120) from the second location using the first and second fly-jib modules simultaneously, shifting the load from a second location (122) to a third location (128), and placing the load on the third location. This step of the method is shown in FIG. 6.

The first and third locations described in the method can be a second floating vessel (30), an offshore structure, a sea bed, or a land-based location.

Figure 7:
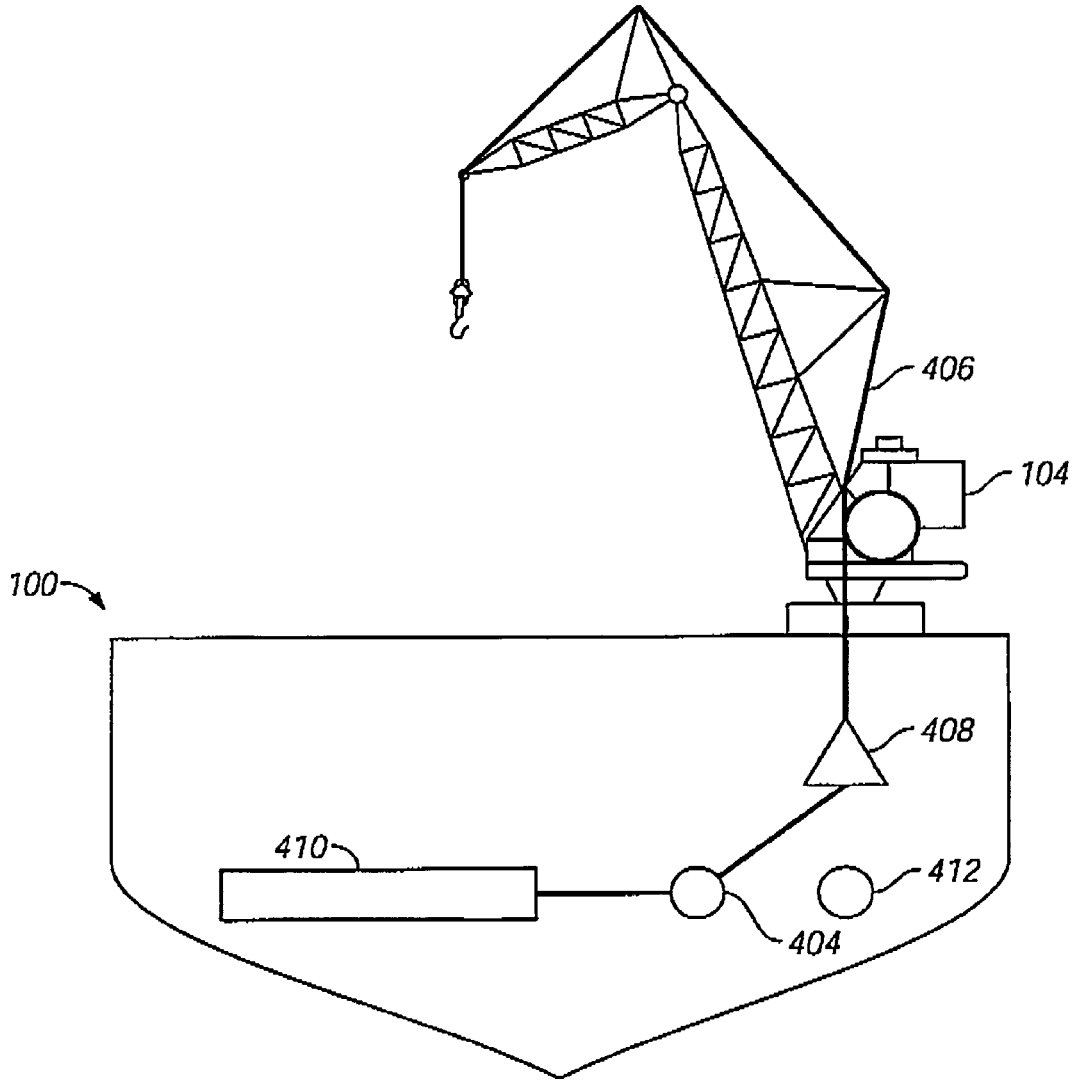
FIG. 7 depicts the deep water deployment system connected to a heavy lift crane.

The heavy lift vessel also can have a deep water deployment system (400) as a module installed. The deep water deployment system (400) is shown in FIG. 7. The deep water deployment system is connected to an individual heavy lift crane to increase the hook travel of the crane. The deep water deployment system (400) has a main hoist winch (404), a wire rope disposed in the heavy lift vessel (406), and a plurality of guide sheaves (408). The main hoist winch (404) of the deep water deployment system (400) bypasses the crane hoist winch (412). The main hoist winch can be a traction winch, a linear winch, or a normal winch. The deep water deployment system (400) can also include separate heave compensators (410) associated with each system.

The preferred use of the method is transportation and installation tasks. Examples of items that are transported and installed using this method are topsides and turrets for FPSOs, wind turbine foundations on monopiles or tripod jacket foundations, wind turbine topsides, small offshore platforms and structures, subsea structures like manifolds and valve skids, and vertical tendons for tension leg platforms. The method can also be used for offshore hook-up and maintenance work as well as civil construction work such as transporting and installing bridge foundations and structures.

The present invention offers the advantage of carrying out the transportation of heavy structures over long distance at high speeds (around 14 to 17 knots). The invention is an improvement over current methods that use regular crane vessels to execute the completion of the installation work. Using the same vessel to both transport and install avoids numerous problem areas, which until now are common in offshore construction work. The method avoids the requirement of additional vessels to handle the cargo in an offshore environment. Conventional installation vessels, such as crane barges or crane vessels, require in most cases a separate barge or heavy lift transport vessel to transport the offshore structures. The conventional installation system requires the cargo to be transferred among vessels multiple times. With each lift, the risk of damage to both cargo and workers increase. The method of the invention reduces the number of required lift vessels to one, thereby lowering the risk of loss and possible damage to cargo and lowering the danger to workers.

While this invention has been described with emphasis on the preferred embodiments, it should be understood that within the scope of the appended claims the invention might be practiced other than as specifically described herein.

What is claimed is:

1. A method for lifting and transporting a heavy load comprising the steps of:

a. using a heavy lift vessel comprising a bow and a stern, wherein the heavy lift vessel comprises a first heavy lift crane and a second heavy lift crane connected to the heavy lift vessel adapted to operate simultaneously, and wherein the heavy lift vessel is located at a first position;

b. mounting a first fly-jib module to the first heavy lift crane and a second fly-jib module to the second heavy lift crane, wherein the first and second fly-jib modules are adapted to increase reach and height of the first and second heavy lift cranes;

c. picking up a load from a first location using the first and second fly-jib modules simultaneously;

d. shifting the load from the first location to a second location, wherein the second location is on the heavy lift vessel;

e. placing the load on the second location;

f. moving the heavy lift vessel to a second position;

g. using a mooring system to maintain the heavy lift vessel at the second position;

h. picking up the load from the second location using the first and second fly-jib modules simultaneously;

i. shifting the load from a second location to a third location;

j. placing the load on the third location; and wherein the heavy lift vessel is a mono-hull vessel.

2. The method of claim 1, wherein the step of using the mooring system further comprises using a suction anchoring system adapted to stabilize the heavy lift vessel from roll, pitch, and heave, and wherein the suction anchoring system comprises:

a. a lifting device with a first end and a second end;

b. a first anchor and a second anchor;

c. a first wire rope connected to the first anchor and a second wire rope connected to the second anchor;

d. at least two first winches disposed on the first end connected to the first wire rope and at least two second winches disposed on the second end connected to the second wire rope; and e. at least two first heave compensators connected to the at least two first winches and a second heave compensators connected to the at least two second winches.

3. The method of claim 2, wherein the step of using the suction anchoring system further comprises using at least:

a. a second lifting device with a second lifting device first end and a second lifting device second end;

b. a third anchor and a fourth anchor;

c. a third wire rope connected to the third anchor and a fourth wire rope connected to the fourth anchor;

d. at least two third winches disposed on the second lifting device first end connected to the third wire rope and at least two fourth winches disposed on the second lifting device second end connected to the fourth wire rope; and e. at least two third heave compensators connected to the at least two third winch and at least two fourth heave compensators connected to the at least two fourth winches.

4. The method of claim 2, wherein the lifting device is a beam.

5. The method of claim 1, wherein the step of using the mooring system further comprises using a modular dynamic positioning system on the heavy lift vessel, wherein the modular dynamic positioning system comprises a. at least a first propeller system, at least a second propeller system, and at least a third propeller system, wherein the first, second, and third propeller systems are disposed on the heavy lift vessel;

b. at least a first generator, at least a second generator, and at least a third generator, wherein the first generator is connected to the first propeller system, the second generator is connected to the second propeller system, and the third generator is connected to the third propeller system, and wherein the first, second, and third generators are disposed in the heavy lift vessel;

c. a control device disposed on the heavy left vessel, wherein the first, second, and third propeller systems and the first, second, and third generators are connected to the control device; and d. a satellite positioning network, wherein the control device is connected to the satellite positioning network.

6. The method of claim 5, wherein the first, second, and third generators are diesel generators or diesel hydraulic power packs.

7. The method of claim 5, wherein the step of using the modular dynamic positioning system further comprises using at least;

a. a fourth propeller system disposed on the heavy lift vessel;

b. a fourth diesel generator, wherein the fourth generator is connected to the fourth propeller system, and wherein the fourth generator is disposed in the heavy lift vessel; and c. wherein the fourth propeller system and the fourth generator are connected to the control device.

8. The method of claim 7, wherein the at least fourth generator is a diesel generator or a diesel hydraulic power pack.

9. The method of claim 1, wherein the step of picking up the load further comprises using a first deep water deployment system in connection with the first heavy lift crane, wherein the first heavy lift crane comprise a first hook, wherein the first deep water deployment system is adapted to increase travel of the first hook of the first heavy lift crane, and wherein the first deep water deployment system comprises:

a. a main hoist winch;

b. a wire rope disposed in the heavy lift vessel; and c. a plurality of guide sheaves.

10. The method of claim 9, wherein the main hoist winch is a traction winch, a linear winch, or a normal winch.

11. The method of claim 9, wherein the step of using the first deep water deployment system further comprises using a heave compensator.

12. The method of claim 9, wherein the step of picking up the load further comprises using a second deep water deployment system in connection with the second lift crane, wherein the second lift crane comprise a second hook, wherein the second deep water deployment system is adapted to increase travel of the second hook of the second heavy lift crane, and wherein the second deep water deployment system comprises:

a. a second main hoist winch;

b. a second wire rope disposed in the heavy lift vessel; and c. a second plurality of guide sheaves.

13. The method of claim 12, wherein the main hoist winch is a traction winch, a linear winch, or a normal winch.

14. The method of claim 12, wherein the step of using the second deep water deployment system further comprises using a heave compensator.

15. The method of claim 1, wherein the step of using the mooring system further comprises using a conventional anchoring system comprising at least two anchors connected to the bow of the heavy lift vessel and a seabed.

16. The method of claim 15, wherein the step of using the conventional anchoring system further comprises using a tugboat connected to the stern of the heavy lift vessel by a wire rope line, wherein the tugboat is adapted to maintain the heavy lift vessel in the direction of prevailing current and wind.

17. The method of claim 1, wherein the first location is a second floating vessel, an offshore structure, a sea bed, or a land-based location.

18. The method of claim 1, wherein the third location is a second floating vessel, an offshore structure, a sea bed, or a land-based location.

19. The method of claim 1, wherein the step of picking up a load further comprises using a first mast crane as the first heavy lift crane and a second mast crane as the second heavy lift crane.

20. The method of claim 1, wherein the step of using a heavy lift vessel further comprises using a heave compensator disposed in the heavy lift vessel.

* * * * *